US005477644A

United States Patent [19]

Chenoweth, Jr.

[11] Patent Number: 5,477,644

[45] Date of Patent: Dec. 26, 1995

[54] LEVELER FOR A DOOR JAMB

[76] Inventor: George E. Chenoweth, Jr., 4515 Woodedge Dr., Hampstead, Md. 21074

[21] Appl. No.: 222,691

[22] Filed: Apr. 4, 1994

[51] Int. Cl.[6] ..... E04B 2/82

[52] U.S. Cl. ..... 52/126.1; 52/217; 49/505

[58] Field of Search ..... 52/126.1, 126.3, 52/126.4, 126.7, 204.1, 217, 210; 49/504, 505

[56] References Cited

U.S. PATENT DOCUMENTS 1,179,597 4/1916 Zahner .
1,754,762 4/1930 Nelson .
2,742,117 4/1956 Tolman ..... 189/46
3,676,966 7/1972 Ragland ..... 52/211
4,224,772 9/1980 Bene et al. ..... 52/233
4,478,016 10/1984 Allen ..... 52/126.1
4,635,414 1/1987 Allen ..... 52/126.1

*Primary Examiner*—Carl D. Friedman
*Assistant Examiner*—Creighton Smith
*Attorney, Agent, or Firm*—Leonard Bloom

[57] ABSTRACT

There is disclosed a door jamb leveler for leveling a door frame, having on the inside surface of the door jamb a slidable foot which is accessible from the outer surface of the jamb to fixedly secure the door jamb with a securing means when the door frame is in a level position.

15 Claims, 7 Drawing Sheets

LEVELER FOR A DOOR JAMB

FIELD OF THE INVENTION

The present invention relates to building construction. More specifically the invention deals with devices for leveling a door frame by adjusting the door jamb.

BACKGROUND OF THE INVENTION

The building industry is a multi-billion dollar industry. Ways are always being sought to make construction more efficient and less costly.

Over time there has been an evolution in the types of materials used in construction, from wood and clay, to brick, steel and cement. Today, plastic has become a material much used in building. There is an emphasis on efficiency and cost effectiveness. Many of the building materials are modular and prefabricated. Over the years improvements have been made in the construction and the installation of window and door frames. The instant invention is concerned with improvements in the construction and installation of door frames. The invention will find applicability in all sorts of construction, from simple housing, to major construction such as apartments, hotels, hospitals and office buildings.

In the prior art the leveling of doors and window frames to make them plumb or level was done by the use of shims or wedges. For example, the door frame was leveled and a shim was forcibly inserted between the bottom of the door jamb and the floor. It is not difficult to imagine that this method was inefficient because to place the shim or shims accurately was time consuming. Further, once the shim was in place it was easy to knock or kick out of place from under the door jamb. In fact the shim was often knocked out of place by construction workers passing the door jamb area. Moreover, the shims were also prone to be knocked out by carpet layers, floor finishers or by the cleaning crew working around the door. Once the shim was knocked out, the door frame became unlevel, and no door could be properly hung. To relevel the door frame a carpenter had to be taken off his job, level the door frame and reset the shim. It is not hard to recognize that the replacement of the accidentally removed shim was time consuming, expensive, and particularly burdensome in construction where costs had to be kept low and the budget maintained.

The invention herein disclosed seeks to eliminate the problem of the accidentally removed shim.

The patent literature sets forth examples of door frame leveling in building construction.

U.S. Pat. No. 1,179,597, issued to Zahner, is directed to a door frame fastener attached to sheet metal door and window frames. The fastener is affixed so that no screws or bolts are visible after the frame has been assembled. The method taught by Zahner allows for vertical and horizontal adjustments of the cases and then the permanent securing of the case. All this is accomplished by the use of a bolt and split nut. The head of the bolt rides in a slot on the inside of the door frame with the split nut being attached in a slot in the door buck. Once the frame is in its proper position the frame outside and opposite the head of the bolt is tapped and the bolt within the split nut binds and secures the frame. A major disadvantage to the frame installation described in the Zahner patent is the fact that once the frame is installed there is no opportunity for further adjustment if the frame becomes unleveled at a future time.

Nelson, in U.S. Pat. No. 1,754,762, sets forth a rather complicated method of securing doors and windows to frame members. Nelson uses adjustable spacing members through which extend screws to secure frame members. The frame member is secured through a bracket attached to a plug in the ground or floor of the building structure. The bracket has a threaded portion through which a screw attached to the frame is inserted, and the frame is adjusted by screwing the screw into the threaded bracket. Nelson's system is cumbersome.

Another rather complicated method for adjusting a door jamb is taught by Tolman in U.S. Pat. No. 2,742,117. The Tolman method involves two mated halves of a door jamb or window. One half of the jamb or window is on one side of the wall and the other half is on the other. Screws are used to securely attach the two halves and added tension is placed on the screws to tighten the two halves to the building structure.

Allen, in U.S. Pat. No. 4,478,016, discloses a door jamb leveler of rather complicated construction and involved operation. The Allen device employs a flange and bar under a jamb. A screw is turned to raise and level the door jamb. Once the jamb is level the frame is permanently secured to the building and the leveling device is removed. No leveling device fixed to the jamb is disclosed by Allen.

None of the prior art teaches a door jamb leveling device which allows for the easy, uncomplicated leveling of the door frame followed by the quick secure fixing of the jamb to position the door frame in a level orientation.

SUMMARY OF THE INVENTION

It is a primary object of this invention to provide an accurate, economical and efficient method for leveling a door frame.

The primary object is realized by providing a door jamb leveler which is able to securely position the door jamb once the door frame has been leveled. Specifically, the door jamb is fixedly set in position by the use of a door jamb leveler attached to the jamb.

The door jamb leveler has as one of its principle components a slidable foot. This slidable foot slides in an open or closed channel formed on the inner surface of the jamb. The slidable foot when fixed by a securing means will firmly position the door jamb and set the door frame in a level position.

The slidable foot can be made of various materials, for example, metal, wood, plastic, etc. In the preferred embodiment of this invention the slidable foot has a slot through which passes a securing means to fixedly engage the slidable foot to secure the door frame in a level position. In this preferred embodiment the securing means is a screw fastened into a nut. The slidable foot of the door jamb leveler has a securing means accessible from the outer surface of the door jamb to fixedly position and secure the slidable foot.

Preferably, a screw accessible from the outer surface through a hole is used to fix the slidable foot, however a cam or like device would be operative. The hole can be recessed to hide the screw. In addition the hole can be capped for decorative purposes to hide the hole.

In a preferred embodiment and in most instances, such as, in a metal door frame the channel mentioned above will be formed by the contour of the door stop. The under surface of the door stop forms a natural channel in which the slidable foot can be positioned and which immobilizes the nut so that it will be able to easily accept the screw. However, note that it is conceptually possible to form a channel at other areas on the back surface of the door jamb.

In a specific application, this invention involves a door jamb leveler for leveling a door frame comprising a door jamb having an inner surface and an outer surface. The inner surface is provided with a slidable leveling means able to slide substantially beyond the bottom edge of the door jamb. A securing means (accessible from the outer surface of the door jamb) fixes and secures the slidable leveling means to the floor below the door jamb. The slidable leveling means can be a slidable foot of a lengthened rectangular configuration. The slidable foot is preferably made of metal, but could be made of wood, plastic, etc. The slidable foot is preferably secured by a nut and bolt, however, means other than a nut and bolt could be employed, e.g., a simple screw or cam. If the foot were made of wood, it could be secured by a nail. Preferably the slidable foot slides in an open channel, however the foot could slide in a closed channel.

The slidable leveling means is a slotted lengthened slidable foot which is secured by tightening a screw accessible through the outer surface of the door jamb into a nut.

The slidable foot is accessed through a hole in the jamb through which the screw is inserted. The hole can be recessed to hide the screw. In order to insure an adequate amount of recess the jamb surface can be thickened. One way of thickening the surface of the jamb is by welding a block onto the back surface of the jamb. For decorative purposes the recessed hole can be capped.

In a most preferred embodiment of this invention the door jamb leveler has a channel on the inner surface of the jamb in which slides a lengthened rectangular slidable foot having a closed-end slot running lengthwise in it. The outer surface of the door jamb is thickened and has a recessed hole for receiving a screw that projects from said hole through said slot and receives a nut riding snugly in said channel such that when the screw is tightened in the nut the slidable foot is immobilized to secure the door frame in a level position.

In its broadest method of operation, the door frame is first substantially leveled. A slidable member is allowed to slide from behind the door jamb to engage the floor while the door frame is in the substantially level position. Finally, from the outer surface of the door jamb, the slidable member is fixed and the door frame is maintained in its substantially level position.

In general the door jamb leveler has been described as being on the hinge side of the jamb, however as an alternative embodiment the door jamb leveler could be on the other jamb or on both jambs of the frame.

It should be noted that the door jamb leveler of this invention is flexible in that in the event the door frame becomes unleveled, as for example the settling of a house foundation or earthquake, the door jamb leveler can be released, the frame releveled and door jamb leveler retightened.

It is to be understood that there are many modifications which could be made to the door jamb leveler of this invention without departing from the spirit thereof. For example:

The screw head could project above the surface rather than fit into a recess.

The head of the screw, such as an Allen-head could be deep-set to receive and retain an Allen-wrench.

BRIEF DESCRIPTION OF THE DRAWINGS

FIG. 8 is a view illustrating checking the level of the door frame using a bubble level.

FIG. 9 is a view illustrating releasing of the movable foot.

FIG. 10 is a pictorial view of the bottom of the door jamb showing adjusting the door jamb and securing the slidable foot. The door jamb is shown shortened.

FIG. 11 is a view showing checking the level of the door frame.

FIG. 12 shows the door being hung after the door frame has been leveled.

FIG. 13 is a pictorial view of the bottom of the door jamb with door attached in finished form.

GENERAL DESCRIPTION OF THE PREFERRED EMBODIMENT

Figure 1:
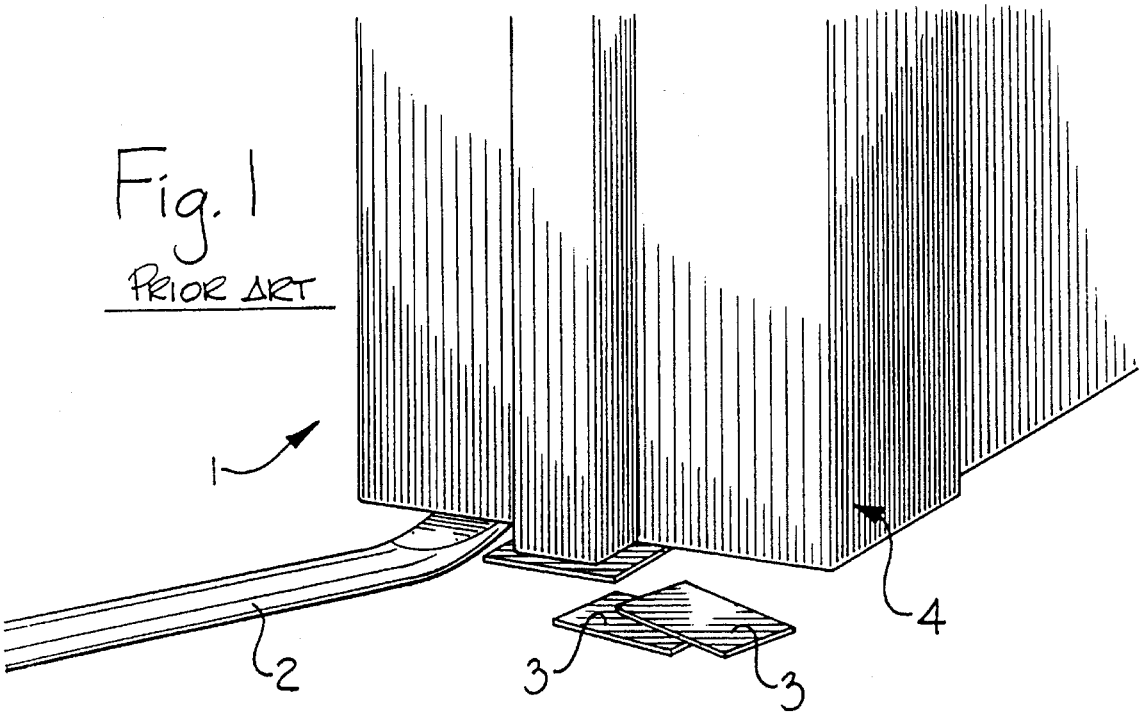
Fig. 1 PRIOR ART
FIG. 1 is a perspective view of the prior art method for leveling a door frame using a pry-bar and shims. The door jamb is shown shortened.
Figure 2:
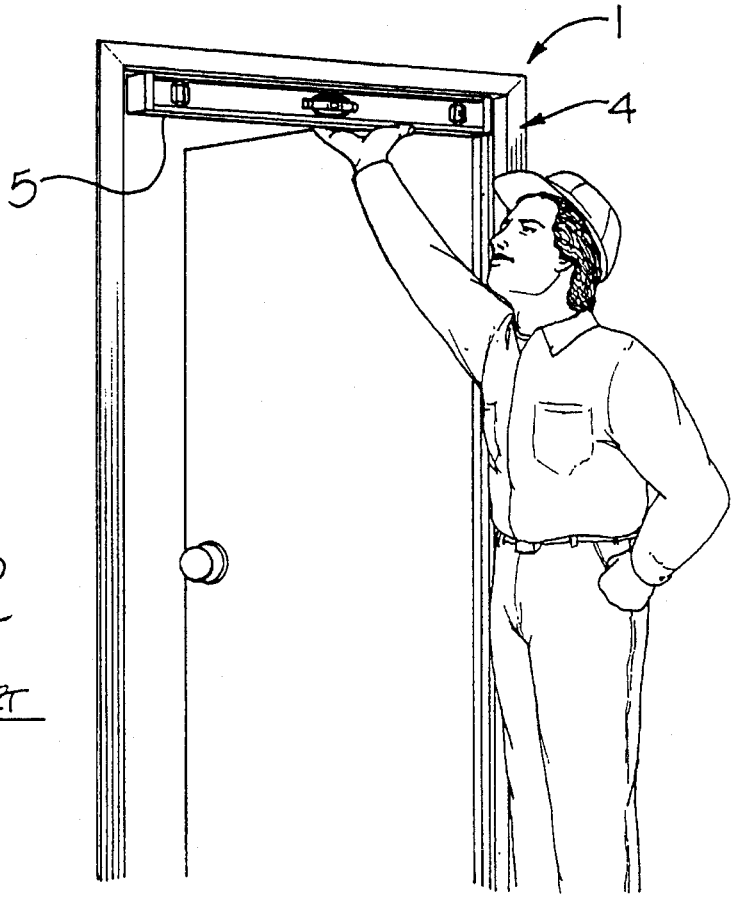
Fig. 2 PRIOR ART
FIG. 2 is a perspective view of the prior art. The workman is shown checking the level of the door frame after the shims have been placed.

With reference to FIGS. 1 and 2, there is illustrated the method long resorted to in the prior art for leveling a door frame 1. In the prior art the door frame 1 was leveled with a pry bar 2 and the level position was fixed by inserting a wedge or shim 3 under the jamb 4 to fix the level position of the door frame 1. (FIG. 1). This method was costly and inefficient because the wedge or shim 3 was often kicked out from under the jamb 4 by workmen passing the door area or by cleaning devices being used to clean around the door. As previously noted, the accidental removal of the shim 3 and its replacement wasted time and incurred added expense. The workman had to return with a bubble level 5 to relevel the door frame 1 and reset the shim 3 (FIG. 2).

Figure 3:
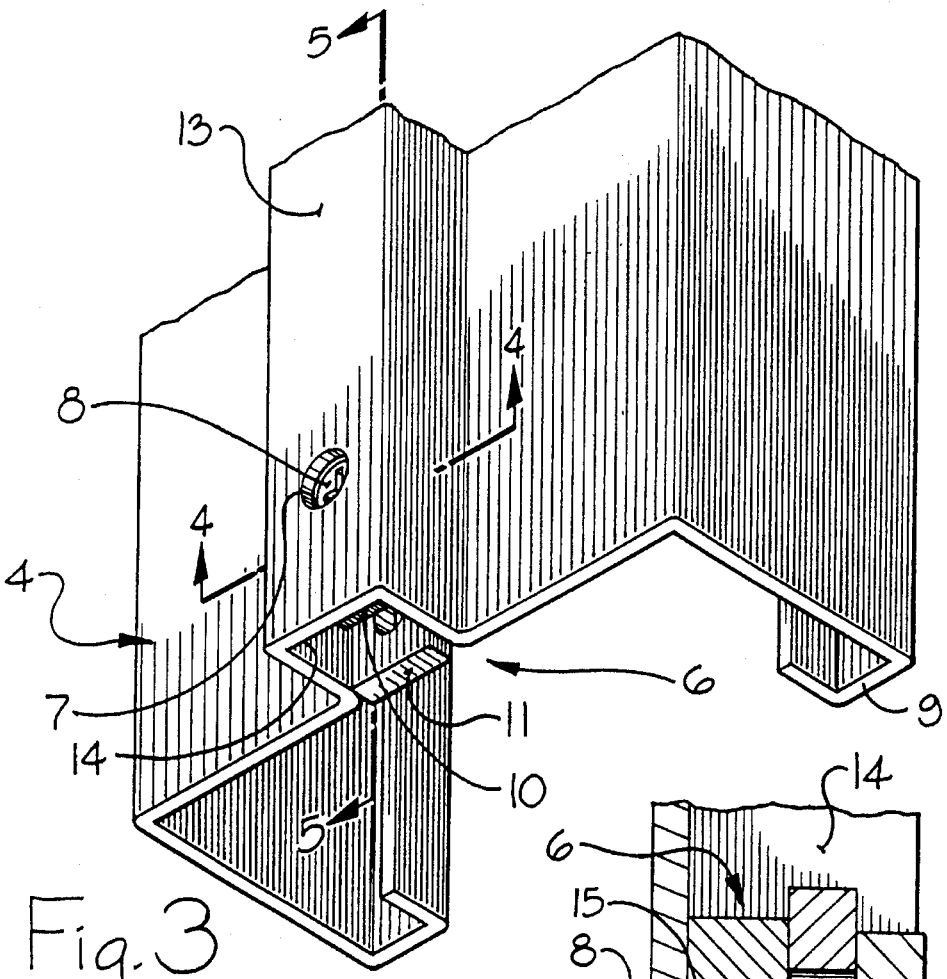
FIG. 3 is a perspective view of the door jamb leveler of the present invention with the door jamb being shown shortened. The movable foot is shown retracted.

Bearing in mind the problems presented by the prior art method of leveling a door frame 1, attention is directed to FIG. 3 which shows the bottom of the door jamb 4 and the door jamb leveler 6 of the present invention. The recessed hole 7 through which the screw 8 penetrates as well as the flange 9 to the door jamb 1 are shown by the figure. The screw 8, welded block 10 and slidable foot 11 are only partially shown by the figure. Hidden from view are the threaded portion of the screw 8 and the nut 12 which binds to the screw 8. Note particularly that part of the outside surface of the door jamb 4 is a door stop 13 which on the inside surface forms a channel 14 which fixedly engages the nut 12. Note also that the slidable foot 11 slides freely up and down in the channel 14 until tightened with the screw 8 in nut 12.

Figure 5:
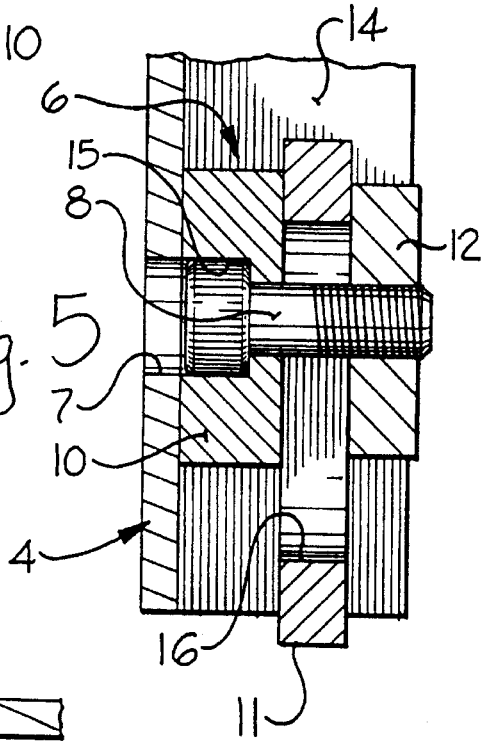
FIG. 5 is a cross-sectional view taken across lines 5–5of FIG. 2 showing the door jamb and door jam leveler of this invention.
Figure 4:
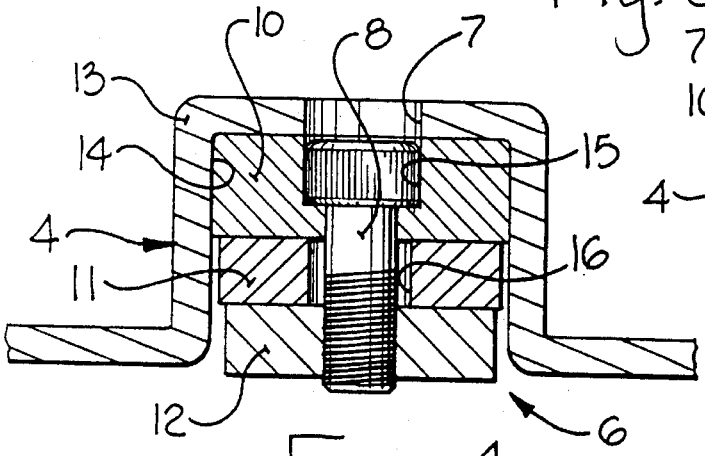
FIG. 4 is a cross-sectional view taken across lines 4—4 of FIG. 3 showing the door jamb and door jamb leveler of this invention.

FIGS. 4 and 5 are cross-sectional views of the door jamb leveler 6 taken across lines 4—4 and lines 5—5. These views show the door jamb 4 with the screw 8 sunk below the surface in the recessed screw hole 7. The door jamb 4 has a block 10 welded to the inside channel 14 of the jamb 4. The welded block 10 has a recess 15 which forms part of the hole which hides the head of the screw 8. The recessed hole 7 serves a dual function. One purpose for the recess 7 is to hide the head of the screw 8. Secondly, the bottom surface of the recess allows the head of the screw 8 to snug up against it when the screw 8 and nut 12 are tightened. The vise-like action between the head of the screw 8 in the recess of the welded block 15 and the nut 12 firmly secures the slidable foot 11 after the door frame 1 is leveled. Note particularly that the nut 12 is positioned snugly within the channel 14 in a way which does not allow the nut 12 to rotate when the screw 8 is being tightened. The elongated closed ended slot 16 on the slidable foot 11 is clearly shown in FIG. 5.

Figure 6:
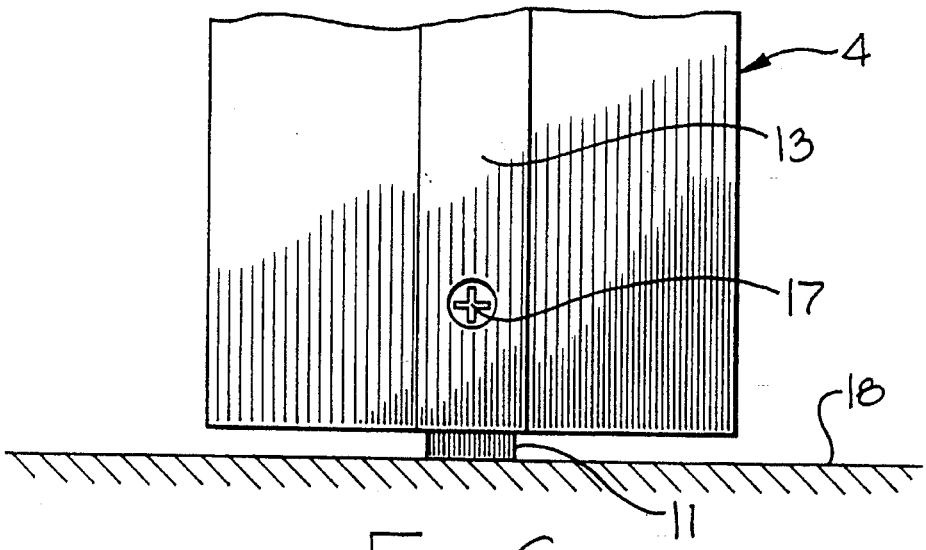
FIG. 6 is an elevational view of the bottom portion of the door jamb showing the foot extended as it would be to level the door frame.

To more fully understand the door jamb leveler, FIG. 6 is presented. This figure more clearly illustrates the head of the screw 8. In the figure shown the head is a Phillips head 17 recessed within the hole 7. However, other screw heads would be operative. The outer surface of the channel or door stop 13 is shown in the figure. Note also that the extended slidable foot 11 is positioned against the floor 18 to level the door frame 1.

Figure 7:
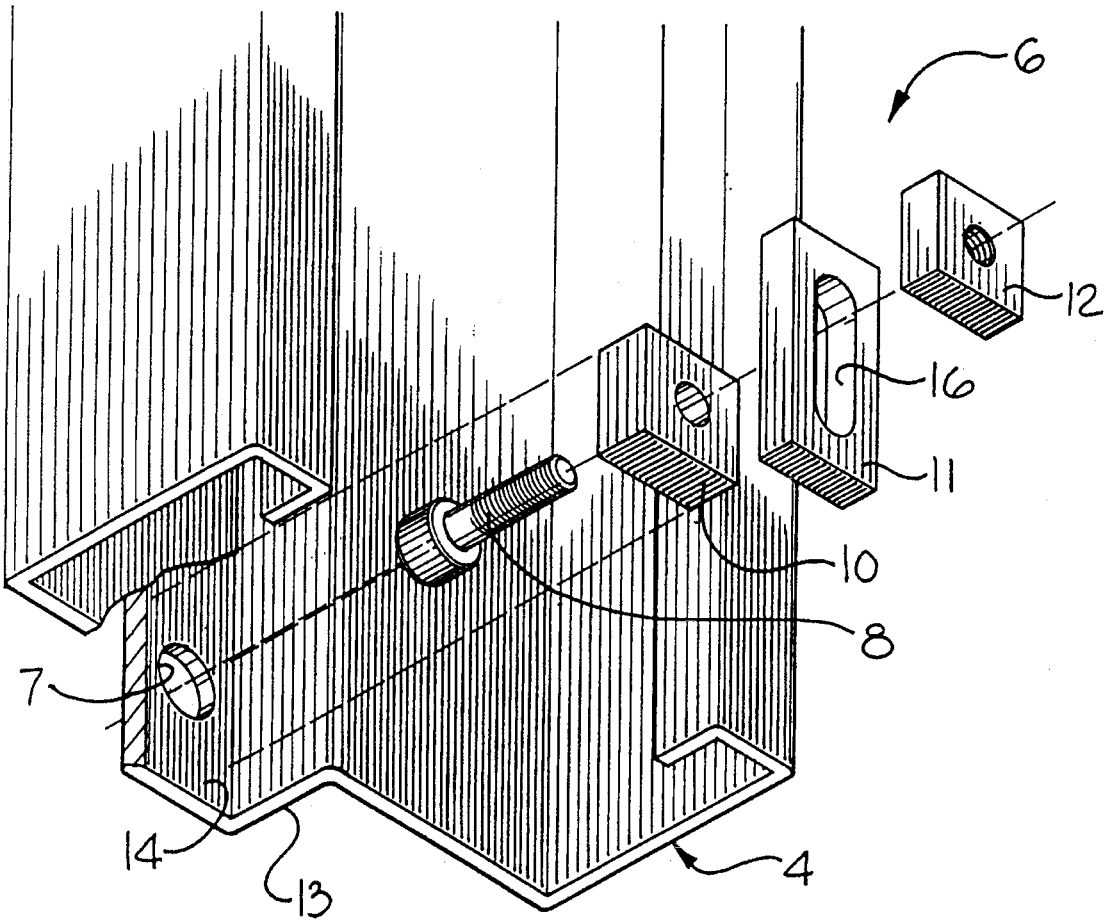
FIG. 7 is a slightly enlarged, exploded view of the door jamb leveler viewed from the inner surface of the door jamb. The welded-in block is shown unwelded. Note also that part of the door jamb at the inner channel is shown broken away.

To better visualize the components of this invention and its operation attention is directed to FIG. 7. This figure is an exploded view showing the component members of the door jamb leveler 6. The door jamb 4 is shown with the screw 8 projecting through the hole 7 in the jamb 4. The welded block 10 is shown unwelded in the channel 14 on the inside surface of the door jamb 4. The slidable foot 11 with the elongated closed-end slot 16 and nut 12 for receiving the screw 8 are all shown.

In operation, the screw 8 is inserted into the recessed hole 7 of the door jamb 4 and the welded block 10. The screw 8 is then threaded through the elongated closed-end slot 16 of the slidable foot 11 sliding freely up and down in channel 14. Finally, the screw 8 engages the nut 12 held snug and prevented from turning in channel 14. The tightening of the screw 8 will compress the slidable foot 11 between the head of the screw 8 in the recess of the welded block 15 and nut 12. The movement of the slidable foot 11 is fixed and the door frame is held in a level position.

FIGS. 8–13 show in detail the method of this invention for leveling a door frame 1, and installing the door 19.

Figure 9:
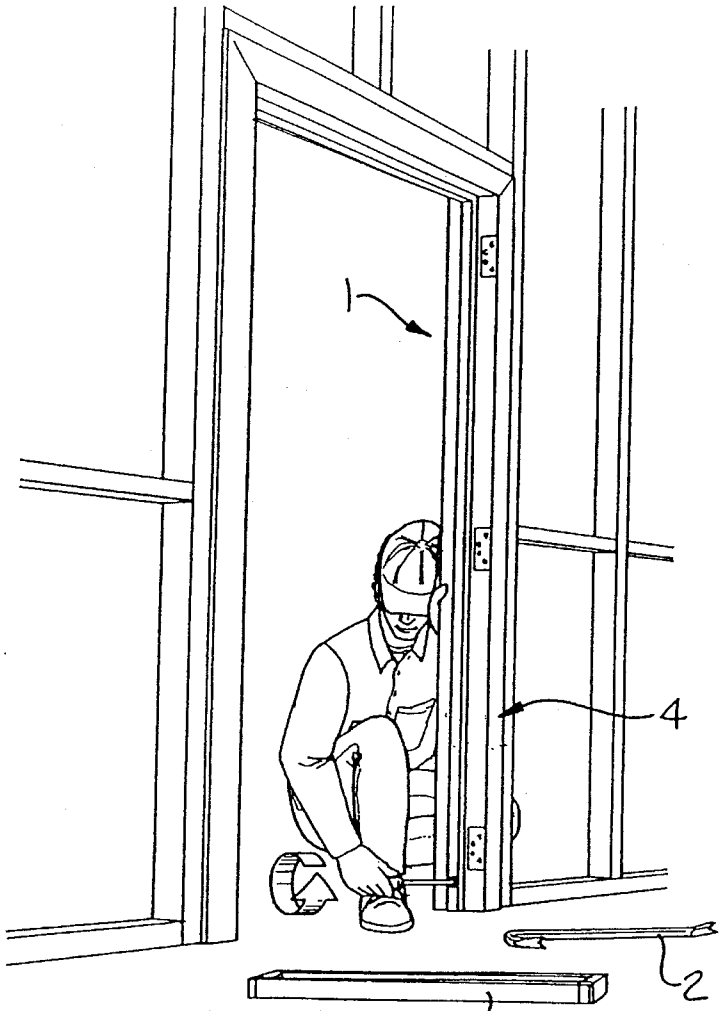
FIGS. 8–13 are views depicting steps used to level a door frame using the leveler for door jam of this invention.
Figure 8:
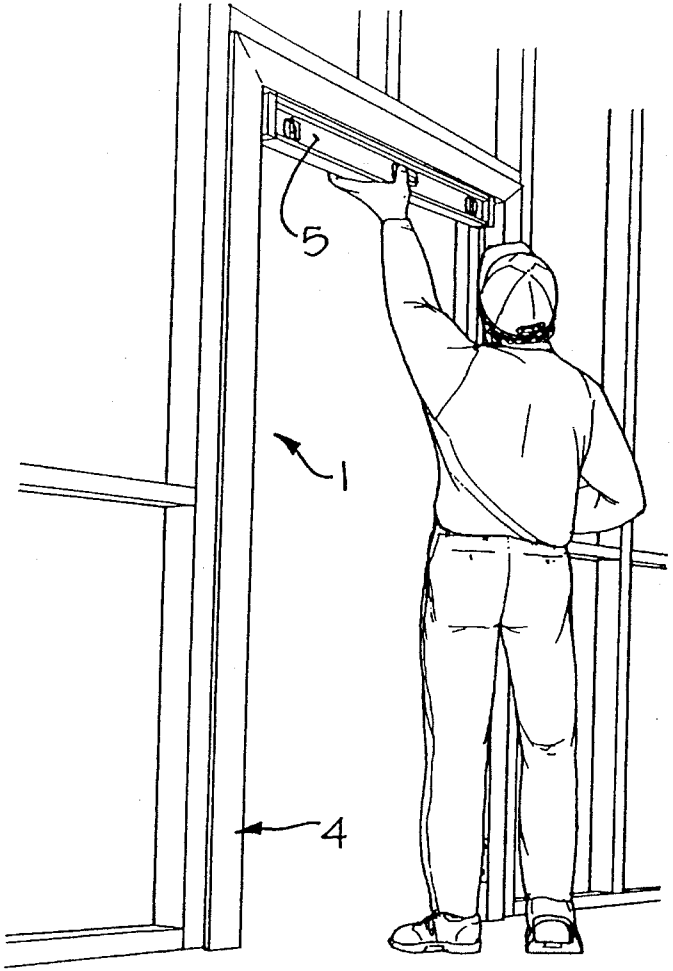
Figure 10:
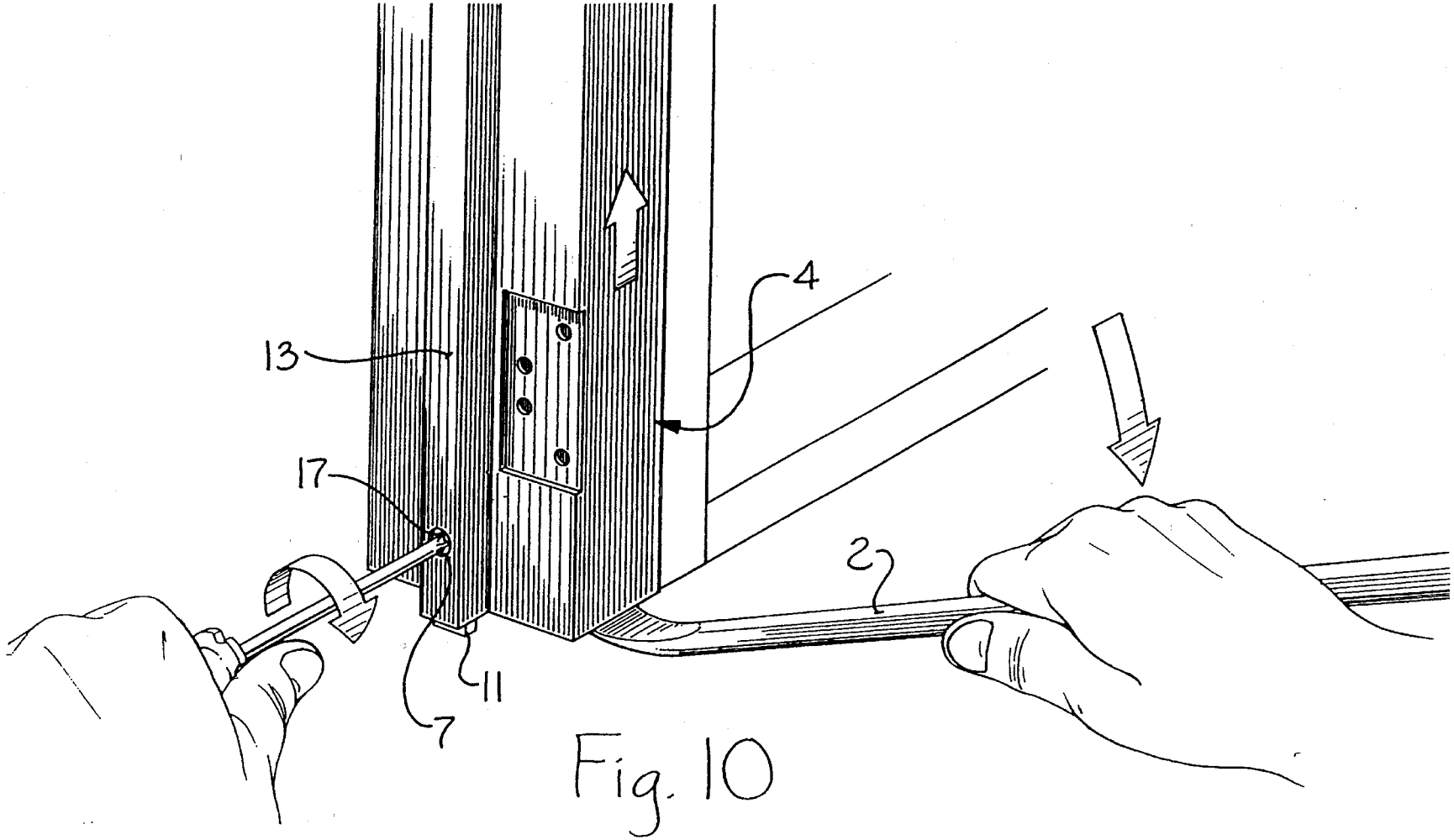
Figure 12:
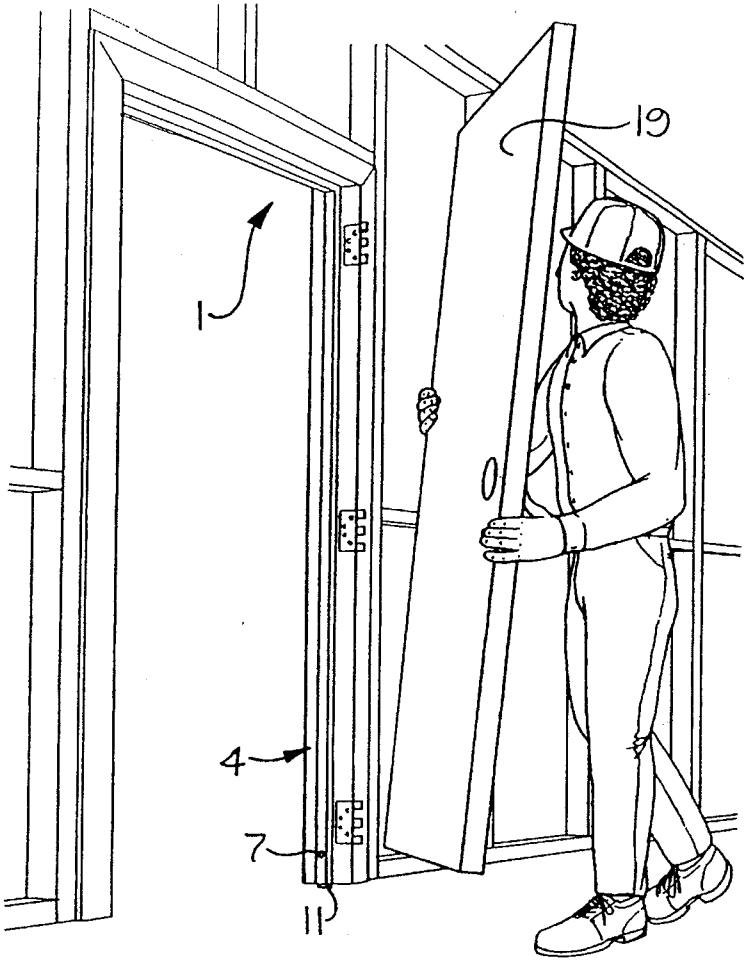
Figure 11:
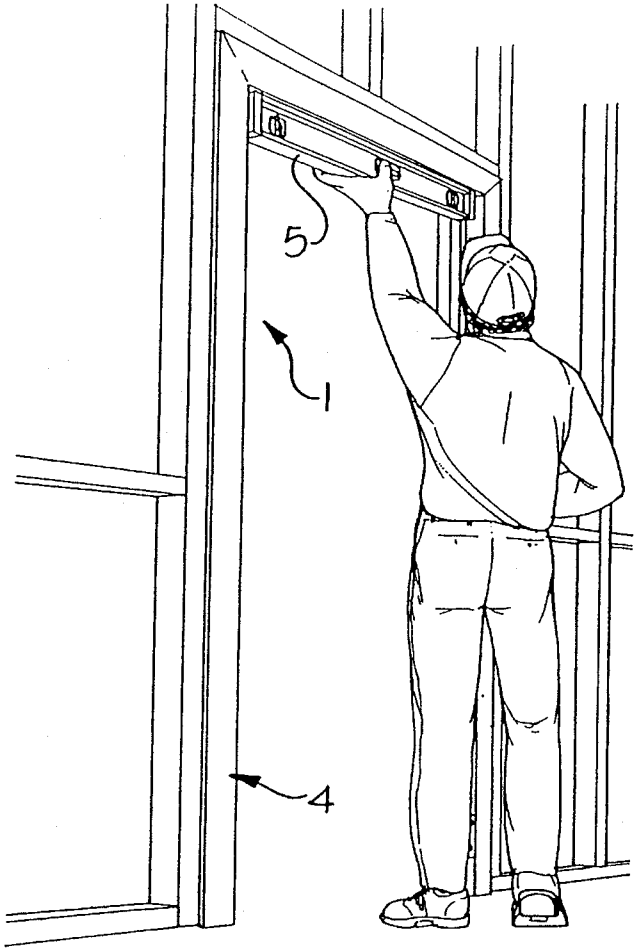
Figure 13:
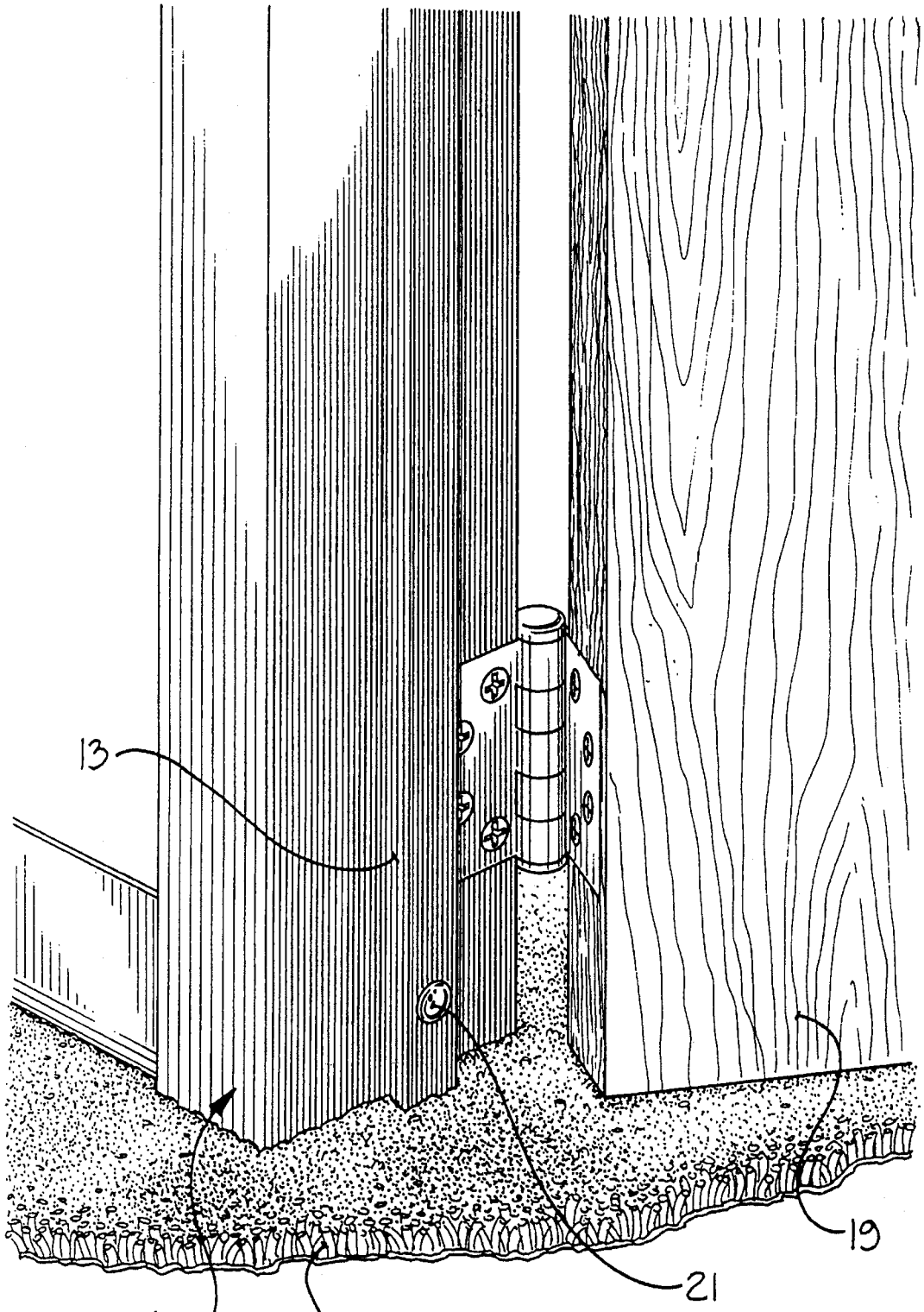

To level the door frame 1, the level of the door frame 1 is first checked with a bubble level 5 (FIG. 8). If the door frame 1 is found to be out of level, the screw 8 of the door jamb leveler 6 is released as shown by the arrow, and the slidable foot is loosened (FIG. 9). FIG. 10 shows the door frame 1 brought to the level position by raising the door jamb 4 with the pry-bar 2 and tightening the set screw 8 which fixedly secures the slidable foot 11 to the floor 18. The arrows show the direction of pry-bar 2 lift, the direction in which the screw 8 is turned and the direction in which the jamb 4 is raised. The door frame 1 is again checked to see that it is level (FIG. 11). If the frame is level, the door 19 is installed on the jamb 4 (FIG. 12). FIG. 13 shows the door 19 hung, carpet 20 laid and the hole 7 in the jamb 4 capped as at 21.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A door jamb leveler for leveling a door frame comprising a door jamb provided with an inner surface and an outer surface, said inner surface containing a slidable leveling means able to slide substantially beyond the bottom edge of the door jamb, said slidable leveling means being accessible from the outer surface of the door jamb to fixedly secure with a securing means, said slidable leveling means to the floor below the jamb.

2. The door jamb leveler for leveling the door frame of claim 1, wherein said leveling means is a lengthened rectangular slidable foot of such length as to be able to extend beyond the bottom of the door jamb to level the door frame.

3. The door jamb leveler for leveling the door frame of claim 2, wherein the securing means for securing the slidable foot is a screw.

4. The door jamb leveler for leveling a door frame of claim 3, wherein the lengthened rectangular slidable foot has an elongated closed-end slot running lengthwise through which projects a screw which is able to fixedly engage the lengthened rectangular slidable foot.

5. The door jamb leveler for leveling a door frame of claim 4, wherein the screw engages a nut to fix the lengthened rectangular slidable foot.

6. A door jamb leveler for leveling a door frame comprising a door jamb provided with an inner surface and an outer surface, said inner surface containing a slidable leveling means able to slide substantially beyond the bottom edge of the door jamb, said slidable leveling means being a lengthened rectangular slidable foot of such length as to be able to extend beyond the bottom of the door jamb to the floor to level the door frame, said slidable leveling means being accessible from the outer surface of the door jamb to fixedly secure the slidable foot with a screw and wherein the means accessible from the outer surface of the door jamb is a hole recessed to hide the head of the screw.

7. The door jamb leveler for leveling a door frame of claim 6, wherein the means accessible from the outer surface of the door jamb is thickened to allow for the hole to be recessed.

8. The door jamb leveler for leveling a door frame of claim 6, wherein the hole accessible from the outer surface of the door is capped to hide the hole.

9. A door jamb leveler for leveling a door frame comprising a door jamb having an inner surface and an outer surface, said inner surface being provided with a channel in which slides a rectangular slidable foot having a slot running lengthwise, said outer surface having a hole receiving a screw which screw projects through said hole and through said slot of the rectangular slidable foot and receives a nut riding snugly in the said channel such that when the screw is tightened in the nut the slidable foot is immobilized and is able to fixedly secure the door frame in a level position.

10. A door jamb leveler for leveling a door frame comprising a door jamb having an inner surface and an outer surface, said inner surface being provided with a channel in which slides a rectangular slidable foot having a slot running lengthwise, said outer surface is thickened to provide a recessed hole to receive a screw Which screw projects through said hole and through said slot of the rectangular slidable foot and receives a nut riding snugly in the same channel such that when the screw is tightened in the nut the slidable foot is immobilized and is able to fixedly secure the door frame in a level position.

11. In combination with a building structure including a floor and further including a door jamb having an elongated vertical channel formed therein, a leveler for the door jamb comprising a foot slidably received within the elongated vertical channel in the door jamb, such that the foot projects below the door jamb and engages the floor in a desired vertically-adjusted position of the door jamb, the foot having a closed vertical slot formed therein, the channel including a wall having an opening formed therein, an externally-accessible screw passing transversely through the opening in the wall of the channel and through the closed vertical slot in the foot, and means including a nut carried by the screw for tightening the foot against the wall of the channel, thereby securing the foot in the selected vertically-adjusted position of the foot in the channel in the door jamb.

12. The combination of claim 11, wherein the nut is disposed within the channel, thereby precluding the nut from rotating when the screw is tightened.

13. In combination with a building structure including a floor and further including door jamb having an elongated vertical channel formed therein, a leveler for the door jamb comprising a foot slidably received within the elongated vertical channel in the door jamb, such that the foot projects below the door jamb and engages the floor in a desired vertically adjusted position of the door jamb, the foot having a closed vertical slot formed therein, the channel including a wall having an opening formed therein, an externally-accessible screw passing transversely through the opening in the wall of the channel and through the closed vertical slot in the foot, the wall of the channel has an inside surface, and wherein a block is secured to the inside surface of the wall of the channel, the block being disposed between the foot and the wall of the channel and means including a nut carried by the screw for tightening the foot against the wall of the channel thereby securing the foot in the selected vertically-adjusted position of the foot in the channel in the door jamb.

14. The combination of claim 13, wherein the block has a recess formed therein, the recess being aligned with the opening in the wall of the channel, and wherein the screw has a head disposed in the recess of the block.

15. In combination with a building structure including a floor and further including a door jamb having an elongated vertical channel formed therein, a leveler for the door jamb comprising a foot slidably received within the elongated vertical channel in the door jamb, such that the foot projects below the door jamb and engages the floor in a desired vertically-adjusted position of the door jamb, the foot having a closed vertical slot formed therein, the channel including a wall having an inside surface and further having an opening formed therein, a block secured to the inside surface of the wall of the channel, the block being disposed between the foot and the wall of the channel, and having a recess formed therein, the recess being aligned with the opening in the wall of the channel, an externally-accessible screw passing transversely through the opening in the wall of the channel, through the block, and through the closed vertical slot in the foot, and a nut carried by the screw for tightening the foot against the block secured to the inside of the wall in the channel, thereby securing the foot in the selected vertically-adjusted position of the foot in the channel in the door jamb, the nut being disposed in the channel, thereby precluding the nut from rotating when the screw is tightened, the block having a recess formed therein, and the screw having a head disposed in the recess in the block.

* * * * *